US006807914B2

(12) United States Patent
Leisse et al.

(10) Patent No.: US 6,807,914 B2
(45) Date of Patent: Oct. 26, 2004

(54) SHUTOFF DEVICE FOR BURNERS OF A PULVERIZED COAL FURNACE

(75) Inventors: Alfons Leisse, Essen (DE); Heinz Gräwe, Hünxe (DE)

(73) Assignee: Babcock Borsig Power Systems GmbH (DE)

( * ) Notice: Subject to any disclaimer, the term of this patent is extended or adjusted under 35 U.S.C. 154(b) by 0 days.

(21) Appl. No.: 10/444,370

(22) Filed: May 23, 2003

(65) Prior Publication Data

US 2003/0226482 A1 Dec. 11, 2003

(30) Foreign Application Priority Data

Jun. 5, 2002 (DE) ..... 102 25 082

(51) Int. Cl.[7] ..... F23K 3/02; F23L 13/00; F23N 3/00

(52) U.S. Cl. ..... 110/106; 110/263; 110/292; 110/147; 110/101 R

(58) Field of Search ..... 110/261, 263, 110/292, 309, 348, 101 R, 104 B, 147–148, 163, 106; 137/607, 867, 865, 862; 126/39 N

(56) References Cited

U.S. PATENT DOCUMENTS 3,602,165 A * 8/1971 Huntington ..... 110/163
4,164,211 A * 8/1979 Onnen ..... 126/285 A
5,299,932 A * 4/1994 Piver ..... 431/354

FOREIGN PATENT DOCUMENTS

| | | |
|---|---|---|
| DE | 1401932 | 10/1968 |
| DE | 3131962 | 7/1985 |
| DE | 40 11 649 | 2/1991 |
| EP | 0 760 922 | 5/2000 |

* cited by examiner

*Primary Examiner*—Kenneth B. Rinehart
(74) *Attorney, Agent, or Firm*—R W Becker & Associates; R W Becker

(57) ABSTRACT

A shutoff device is provided for pulverized coal burners of a pulverized coal furnace. Each burner has a primary tube that conveys a pulverized coal/air mixture and is connected with a feed line for supplying the mixture to the respective burner. Disposed in the feed line, for closing off the same, is a slide valve that is provided with a valve plate. On the trailing side of the slide valve, the feed line is surrounded by an air receiver that is supplied with air. In the vicinity of the air receiver, an opening is provided in the wall of the feed line and can be closed off by a closure plate, which is synchronously actuatable with the slide valve such that in the closed position of the slide valve the opening is opened, and in the open position of the slide valve the opening is closed off.

6 Claims, 3 Drawing Sheets

SHUTOFF DEVICE FOR BURNERS OF A PULVERIZED COAL FURNACE

BACKGROUND OF THE INVENTION

The present invention relates to a shutoff device for pulverized coal burners of a pulverized coal furnace.

In steam generators, the furnace of which is equipped with two or more pulverized coal burners, burners that are shut down during the operation of a steam generator are supplied with cooling air via the combustion air supply lines (secondary air, tertiary air) to protect the burner nozzles from being thermally overstressed. The primary tube of the pulverized coal burners, via which the introduction of fuel is effected during the operation, do not have cooling air flow therethrough when burners are not in operation.

In conformity with all applicable regulations relative to the equipping and operation of pulverized coal furnaces or steam generators in which pulverized coal is injected into the combustion chamber via two or more burners, and which are supplied with pulverized coal from two or more parallel fuel systems, the pulverized coal supply line must be provided with shutoff devices that are reliably opened during the operation of the pertaining supply systems, and after the pertaining fuel supply device is turned off must be closed. This is generally realized with shutoff mechanisms where a shut-off plate is inserted into the cross-section of the pertaining supply lines perpendicular to the axis of flow by an automatically and/or manually actuated drive means. As a result, the complete blocking of the corresponding fuel supply paths is effected. In this state, there is no flow-through of the fuel paths and hence also no cooling of the pulverized coal burner nozzles.

Due to the lack of flow-through, and due to the pressure and velocity conditions in the combustion chamber of the pulverized coal furnace, hot combustion gases can re-circulate into the fuel nozzles of the turned-off burners. Especially with modern $NO_x$—poor pulverized coal burners, where the position of the fuel nozzles is shifted as far as possible in the direction of the combustion chamber, the high irradiation effects an intensive increase in temperature in the material of the burner nozzles. As a consequence of the irradiation and the lack of flow-through a premature failure or destruction of the pulverized coal nozzles can occur due to thermal overstressing of the material.

It is therefore an object of the present invention to provide a closed system for the cooling of the pulverized coal supply path within a pulverized coal burner via an air stream without in so doing adversely affecting the necessary safety device, namely the blocking or closing off of the pulverized coal supply path.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
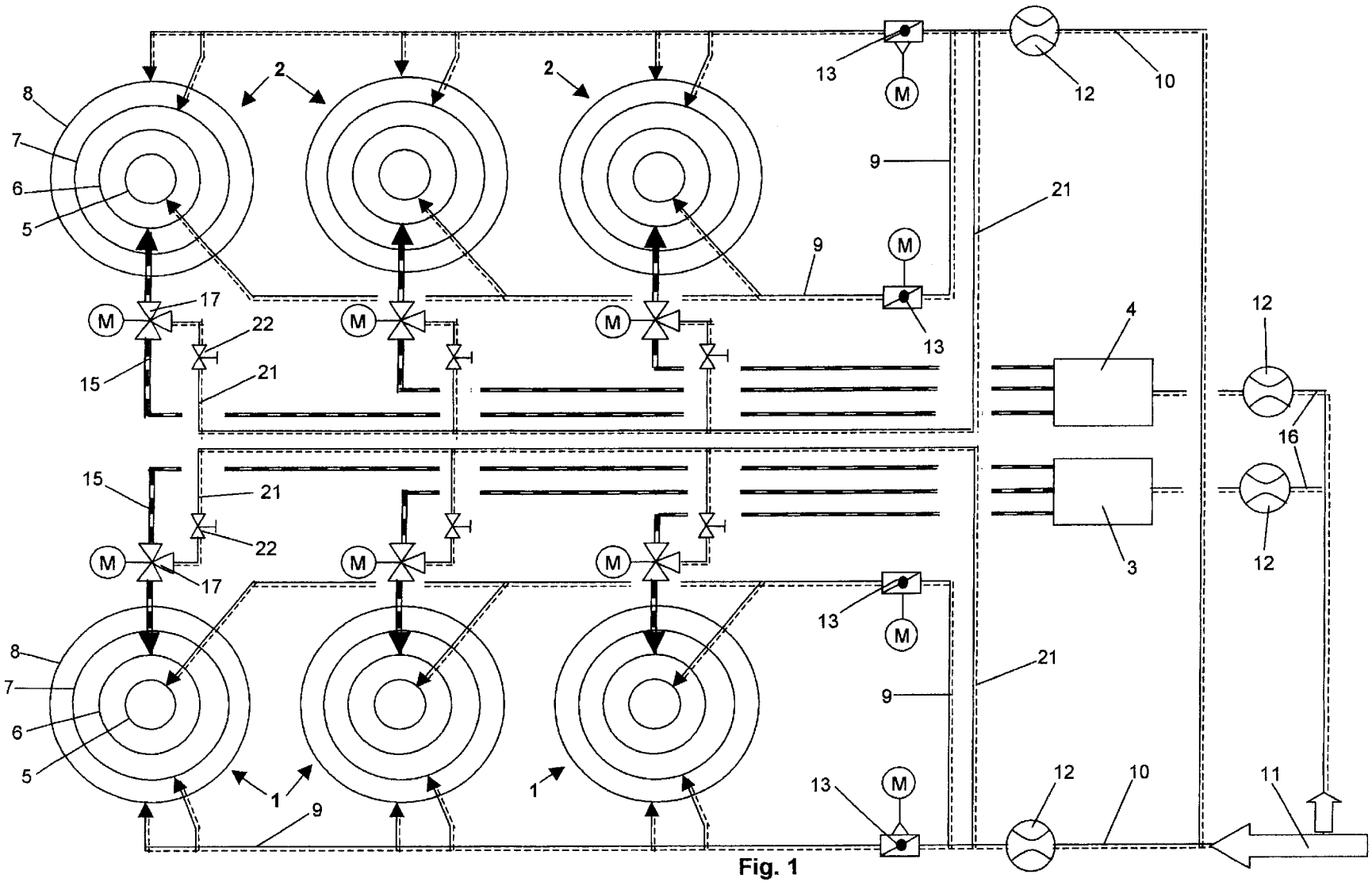
FIG. 1 diagrammatically shows a pulverized coal furnace.

The shutoff device of the present invention for pulverized coal burners of a pulverized coal furnace comprises, for each burner, a feed line for conveying pulverized coal/air mixture to a primary tube; a slide valve disposed in the feed line, wherein the slide valve is provided with a valve plate for closing off the feed line; an air receiver that is supplied with air, wherein on a trailing side of the slide valve, the feed line is sealingly connected with the air receiver; and a closure plate for opening and closing off an opening disposed in the wall of the feed line in the vicinity of the air receiver, wherein the closure plate is actuatable synchronously with the slide valve such that in a closed position of the slide valve the opening is opened, and in an open position of the slide valve the opening is closed off.

As a consequence of the combination of the cooling device with the shutoff device of the pulverized coal burner, a closed system is achieved that complies with all safety regulations. It is furthermore ensured that during the operation of the pulverized coal burner, no pulverized coal can escape into the environment from the supply lines that are provided therefor.

Further specific features of the present invention will be described in detail subsequently.

DESCRIPTION OF PREFERRED EMBODIMENTS

Referring now to the drawings in detail, the illustrated pulverized coal furnace comprises two sets of three pulverized coal burners 1,2 each, which sets are connected in series and are supplied pulverized coal via two fuel supplying means 3,4. Depending upon the given requirements of the pulverized coal furnace, a different number of fuel supply means 3,4 and pulverized coal burners 1,2 can also be provided. The fuel supply means 3,4 can comprise a pulverizing unit and/or an intermediate hopper.

Figure 2:
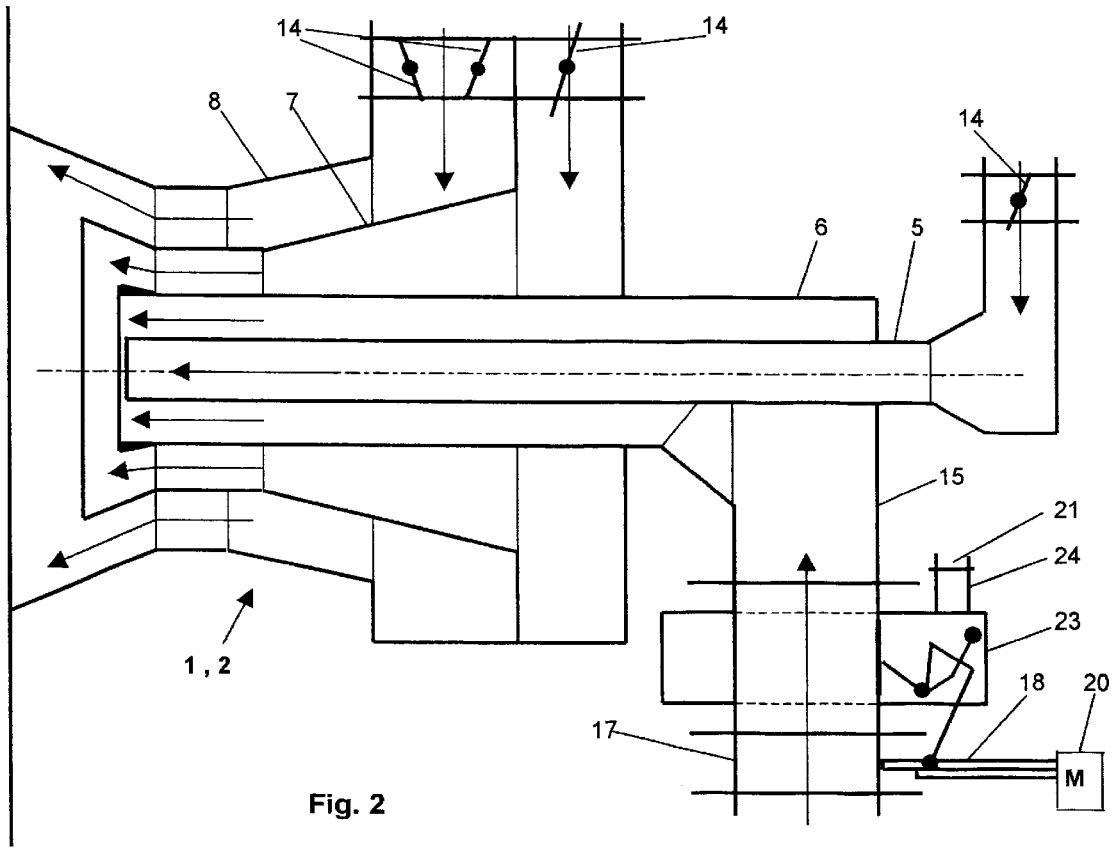
FIG. 2 shows a pulverized coal burner of the furnace of FIG. 1.

The pulverized coal burners 1,2 are embodied as annular burners having staged combustion air guidance. As can be seen from FIGS. 1 and 2, each of the burners contains a central core air tube 5 that is concentrically surrounded by a primary tube 6, a secondary tube 7 and a tertiary air tube 8. The central core air tube can also be eliminated. The burner nozzles, which are respectively disposed at the front end of the pulverized coal burners 1,2, open out into a non-illustrated combustion chamber of a steam generator. The core air tube 5, the secondary air tube 7 and the tertiary air tube 8 are connected to a central combustion air supply means 11 via air conduits 9 and combustion air conduits 10. The core air tube 5, the secondary air tube 7 and the tertiary air tube 8 are supplied with combustion air from the combustion air supply means 11 via the air conduits 9 and the combustion air conduits 10; prior to entry into the pulverized coal burners 1,2, the combustion air is divided into core air, secondary air and tertiary air. Disposed in the combustion air conduits 10 are flow meters 12, and disposed in the air conduits 9 are control or throttle valves 13. As shown in FIG. 2, throttle valves 14 can also be disposed in the entry region of the core air 5, of the secondary air tube 7 and of the tertiary air tube 8; these throttle valves 14 serve to supply to the air-supplying tubes quantities of combustion air that are coordinated with one another. If an individual one of the pulverized coal burners 1,2 is taken out of operation, an air stream of less magnitude is guided, as a cooling air stream, through the tubes 5, 7, 8 that guide the aforementioned combustion air streams.

The primary tube 6 of each of the pulverized coal burners 1,2 is connected to a feed line 15 that in turn is connected to one of the fuel supply means 3, 4, which are respectively connected with a primary air conduit 16, in which is disposed a flow meter 12. The primary air supplied to the fuel supply means 3, 4 conveys the pulverized coal, as a pulverized coal/air mixture, to the primary tubes 6 of the pulverized coal burners 1,2.

Figure 3:
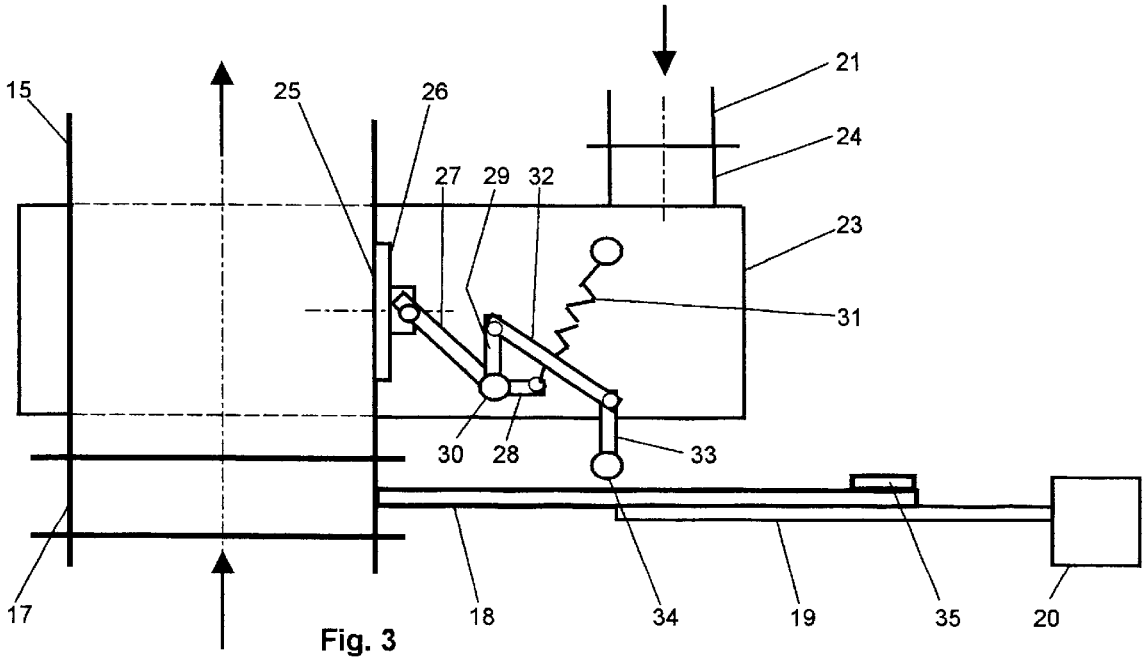
FIGS. 3–5 show various operating positions of one exemplary shutoff device for a pulverized coal burner of FIG. 2.

Upstream of, i.e. prior to, the entry into the respective pulverized coal burner 1,2, a shutoff device that is embodied as a slide valve 17 is disposed in each of the feed lines 15; the shutoff device is oriented transverse to the axis of the direction of flow of the pulverized coal/air mixture. The slide valve 17 comprises a valve plate 18 to which is secured a connecting rod 19 (FIG. 3). A drive motor 20 or a manual adjustment means engages the connecting rod 19 for actuation of the valve plate 18. In the closed position of the slide valve 17, the valve plate 18 completely closes off the cross-sectional area of the feed line 15, as illustrated in FIG. 5.

The shutoff device is combined with a cooling device for cooling the components of the respective pulverized coal burners 1,2, which convey the pulverized coal/air mixture. A partial stream of the combustion air preferably serves as the cooling medium. For this purpose, the combined shutoff/cooling device of one of each pulverized coal burner 1,2 is connected to a cooling air conduit 21 on which is disposed a shutoff member 22 (FIG. 1). The cooling air conduits 21 are preferably connected to the combustion air conduits 10. Depending upon the operating requirements and the position of the installation location of the slide valve 17, instead of the hot combustion air from the combustion air supply means, other air that is available in the pulverized coal furnace, for example the cold air supplied to the pulverizer, or even flue gas, can also be utilized.

In detail, the cooling device of each of the pulverized coal burners 1,2 comprises an air receiver 23 that, upstream of the slide valve 17, is mounted on the side of the feed line 15, through which the pulverized coal/air mixture flows, and is sealingly connected with such feed line. Downstream of the slide valve 17, the feed line 15 is preferably surrounded by the air receiver 23 on all sides and in a sealing manner. The air receiver 23 is provided with an inlet connector 24 that is respectively connected to one of the cooling air conduits 21.

Figure 4:
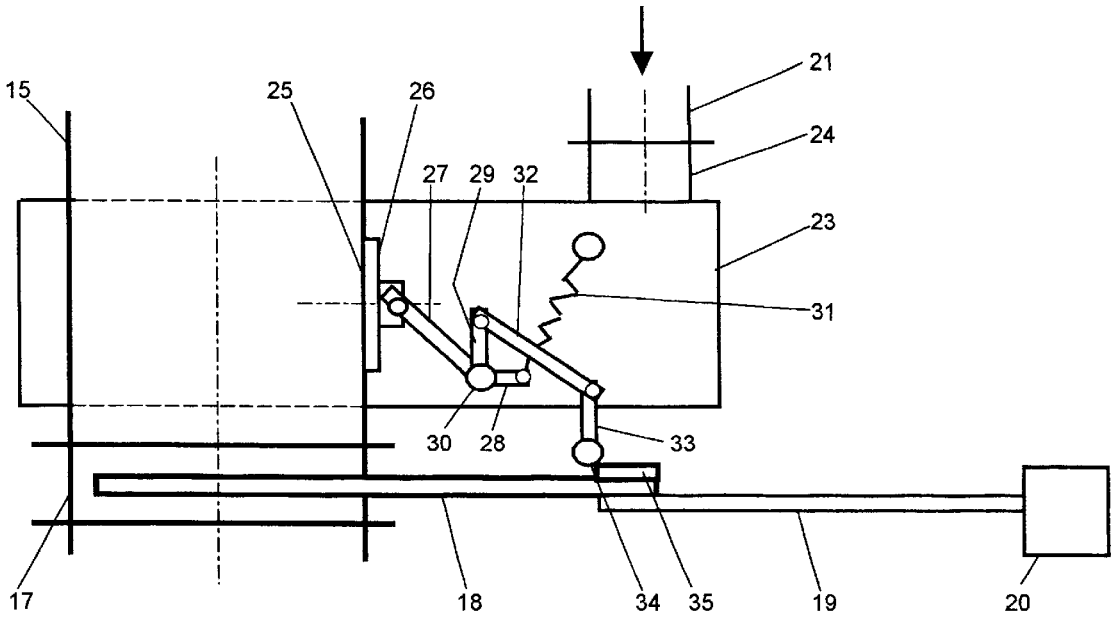
Figure 5:
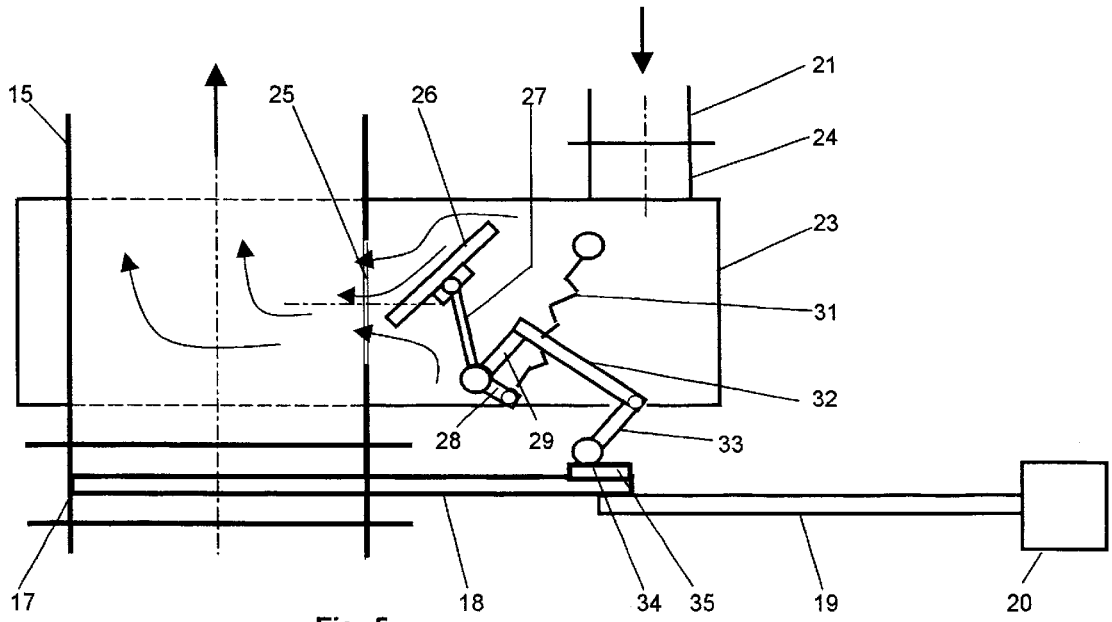

Pursuant to FIGS. 3 to 5, provided in the region of the air receiver 23, in the wall of the feed line 15, is an opening 25 that can be closed from the interior of the air receiver 23 by a closure plate 26. On that side facing away from the opening 25 a first lever 27 is pivotably mounted on the closure plate 6. The first lever 27, as are a second lever 28 and a third lever 29, is fixably connected with a shaft 30 that is mounted in a swivel joint. The shaft 30 is rotatably mounted in the air receiver 23 and extends out of the air receiver on both sides in a sealed manner. Outside the air receiver 23, the levers 28 and 29 are respectively fixedly connected with one of the ends of the shaft 30 that extends out. A spring 31 that is under tension engages the free end of the second lever 28; the spring 31 is secured to the outside of the air receiver 23. The free end of the third lever 29 is connected with a link rod 32 that pivotably engages a fourth lever 33 that is fixedly connected with a shaft of a pinion or gear 34. This pinion is in operative connection with a toothed rack 35 that is mounted on the rear end of the valve plate 18 of the slide valve 17.

The combined shutoff and cooling device operates in the following manner. In the operating situation of the pulverized coal furnace (FIG. 3) the feed line 15 is opened for the supply of pulverized coal/air mixture to the respective pulverized coal burners 1,2, and the opening 25 in the wall of the feed line 15 is closed to the entry of cooling air. In this connection, by means of the first lever 27 and the second lever 28 that is fixedly connected therewith, the closure plate 26 is pressed tightly against the opening 25 in the wall of the feed line 15 by the spring 31 that is disposed on the side. The air receiver 23, which in this region surrounds the feed line 15, is filled with air, so that a uniform temperature is established in this region of the feed line 15. This precludes a distortion or buckling of the feed line 15 and of the closure plate 28 due to non-uniform thermal stressing. The static pressure of the cooling air in the air receiver 23 is always greater than the static pressure of the pulverized coal/air mixture in the feed line 15. As a result, any possible leakage is possible only in the direction of the flow path of the pulverized coal/air mixture, so that no pulverized coal can escape into the air receiver 23.

In the operating position of the slide valve 17 shown in FIG. 4, the supply of fuel to the pertaining ones of the respective coal burners 1,2 is already concluded, and the valve plate 18 of the slide valve 17 is already closed by 90%. The toothed rack 35 is mounted on the valve plate 18 at such a distance from the front edge thereof that the toothed rack 35, during the course of the closure movement of the slide valve 17, engages the pinion 34 only shortly before the closed position is achieved. As a result, the closure plate 26 is still held in the closed position by the force of the spring 31.

As the feed line 15 is blocked still further, the toothed rack 35 actuates the pinion 34, as a result of which, via the fourth lever 33, the link rod 32, the third lever 29 and the first lever 27, the closure plate 26 is actuated against the effective force of the spring 31. The actuation of the closure plate 26 is thus effected directly via the valve plate 18 of the slide valve 17. The closure plate 26 now releases the opening 25. In this position, the path of the supply of fuel is reliably blocked. The cooling air flows via the opening 25 in the wall of the feed line 15 onto the trailing side of the slide valve 17 and exits at the burner nozzle of the respective pulverized coal burner 1,2 and enters the combustion chamber. As a result of this air flow, in addition to cooling of the primary tube 6 and the burner nozzle, a flowing of hot combustion gases back into the pulverized coal burner 1,2 is prevented. The direction of flow of the cooling air and of the pulverized coal/air mixture can be recognized by arrows in FIGS. 3 to 5.

The specification incorporates by reference the disclosure of German priority document 102 25 082.0 filed Jun. 5, 2002.

The present invention is, of course, in no way restricted to the specific disclosure of the specification and drawings, but also encompasses any modifications within the scope of the appended claims.

What is claimed is:

1. A shutoff device for pulverized coal burners of a pulverized coal furnace, comprising, for each burner:

a primary tube;

a feed line for conveying pulverized coal/air mixture to said primary tube;

a slide valve disposed in said feed line, wherein said slide valve is provided with a valve plate for closing-off the feed line;

an air receiver that is supplied with air, wherein on a trailing side of said slide valve, said feed line is sealingly connected with said air receiver; and a closure plate for opening and closing off an opening disposed in a wall of said feed line in the vicinity of said air receiver, wherein said closure plate is actuatable synchronously with said slide valve such that in a closed position of said slide valve said opening is open, and in an open position of said slide valve said opening is closed off.

2. A shutoff device according to claim 1, wherein on said trailing side of said slide valve, said air receiver surrounds said feed line on all sides in a sealing manner.

3. A shutoff device according to claim 1, wherein a static pressure of air in said air receiver is kept at a higher value than a pressure of pulverized coal/air mixture in said feed line.

4. A shutoff device according to claim 1, wherein said closure plate is provided with a linkage comprised of a plurality of levers and a link rod, wherein a spring is provided that is under tension and that engages said linkage, wherein said spring is adapted to hold said closure plate in a closed position, and wherein said linkage is mechanically coupled with said valve plate of said slide valve.

5. A shutoff device according to claim 4, wherein a toothed rack is disposed on said valve plate of said slide valve, wherein a stationarily mounted pinion is fixedly connected with one of said levers of said linkage, and wherein said toothed rack is adapted to engage said pinion at the end of a closure path of said slide valve.

6. A shutoff device according to claim 5, wherein a first lever of said linkage is pivotably connected to a side of said closure plate that is remote from said feed line, wherein said first lever is fixedly connected with a shaft that is mounted in said air receiver, wherein said shaft extends out of two opposite sides of said air receiver in a sealed manner, wherein a second and third lever of said linkage are connected with said shaft outside of said air receiver, wherein a free end of said second lever engages said spring, and wherein a free end of a third lever is pivotably connected via said link rod with said lever that is fixedly connected with said pinion.

* * * * *